US008997967B2

(12) United States Patent
Asada

(10) Patent No.: US 8,997,967 B2
(45) Date of Patent: Apr. 7, 2015

(54) BANKNOTE HANDLING MACHINE

(71) Applicant: Glory Ltd., Himeji-shi, Hyogo-ken (JP)

(72) Inventor: Toshihide Asada, Himeji (JP)

(73) Assignee: Glory Ltd., Himeji-Shi, Hyogo-Ken (JP)

( * ) Notice: Subject to any disclaimer, the term of this patent is extended or adjusted under 35 U.S.C. 154(b) by 0 days.

(21) Appl. No.: 13/778,233

(22) Filed: Feb. 27, 2013

(65) Prior Publication Data

US 2013/0220897 A1 Aug. 29, 2013

(30) Foreign Application Priority Data

Feb. 27, 2012 (JP) ..... 2012-40026

(51) Int. Cl.
*G07F 7/04* (2006.01)
*B07C 5/34* (2006.01)
*G07D 11/00* (2006.01)

(52) U.S. Cl.
CPC . *B07C 5/34* (2013.01); *G07D 11/00* (2013.01)

(58) Field of Classification Search
USPC ..... 194/206, 217; 209/534; 235/379; 700/221, 226
See application file for complete search history.

(56) References Cited

U.S. PATENT DOCUMENTS 7,735,621 B2 * 6/2010 Hallowell et al. ..... 194/206
2009/0183967 A1 7/2009 Hamasaki

FOREIGN PATENT DOCUMENTS

| | | | |
|---|---|---|---|
| CN | 2317507 | Y | 5/1999 |
| CN | 1361495 | A | 7/2002 |
| CN | 101154301 | A | 4/2008 |
| CN | 101606183 | A | 12/2009 |
| CN | 101923744 | A | 12/2010 |
| CN | 202058233 | U | 11/2011 |
| CN | 102289859 | A | 12/2011 |
| EP | 1 531 432 | A2 | 5/2005 |
| EP | 2 110 789 | A1 | 10/2009 |
| JP | 3936529 | B2 | 6/2007 |
| JP | 4351797 | B2 | 10/2009 |

OTHER PUBLICATIONS

European Search Report (Application No. 13156894.1) (6 pages—dated Jul. 6, 2013).
Chinese Office Action with English translation (Chinese Patent Application No. 201310180163.8) (33 pages—dated Sep. 30, 2014).

* cited by examiner

*Primary Examiner* — Mark Beauchaine
(74) *Attorney, Agent, or Firm* — Renner, Kenner, Greive, Bobak, Taylor & Weber

(57) ABSTRACT

In one embodiment, a banknote handling machine includes a recognition unit configured to recognize a kind of each banknote taken in a take-in unit, a plurality of stacking units, respectively configured to stack therein the banknotes, a transport unit configured to transport the banknotes, respectively recognized by the recognition unit, to any of the plurality of stacking units, an instruction accepting unit configured to accept an instruction concerning an automatic decision mode provided for deciding the kind of the banknotes to be stacked, by utilizing a recognition result obtained by the recognition unit, for each of the plurality of stacking units, and a control unit configured to control the transport unit to transport each banknote to a destination, which destination is decided based on the instruction accepted by the instruction accepting unit and on the recognition result obtained by the recognition unit.

9 Claims, 26 Drawing Sheets

SETTING FOR ASSIGNMENT MODE

| | STACKING UNIT 65a | STACKING UNIT 65b | STACKING UNIT 65c | STACKING UNIT 65d | STACKING UNIT 65e | STACKING UNIT 65f | STACKING UNIT 65g | STACKING UNIT 65h |
|---|---|---|---|---|---|---|---|---|
| CURRENCY | FIRST AUTOMATIC | FIRST AUTOMATIC | FIRST AUTOMATIC | SECOND AUTOMATIC | SECOND AUTOMATIC | THIRD AUTOMATIC | THIRD AUTOMATIC | MIXTURE |
| DENOMINATION | FIRST AUTOMATIC | SECOND AUTOMATIC | THIRD AUTOMATIC | FIRST AUTOMATIC | SECOND AUTOMATIC | FIRST AUTOMATIC | SECOND DYNAMIC | MIXTURE |

| | |
|---|---|
| DESIGNATION MODE | USD |
| | EUR |
| | JPY |
| | : |
| | : |
| AUTOMATIC DECISION MODE | FIRST AUTOMATIC DECISION |
| | SECOND AUTOMATIC DECISION |
| | THIRD AUTOMATIC DECISION |
| DYNAMIC DECISION MODE | FIRST DYNAMIC DECISION |
| | SECOND DYNAMIC DECISION |
| | THIRD DYNAMIC DECISION |
| MIXTURE MODE | |
| NON-DESIGNATION MODE | |

FIG. 5

| | |
|---|---|
| DESIGNATION MODE | $100 |
| | $50 |
| | $20 |
| | : |
| | : |
| AUTOMATIC DECISION MODE | FIRST AUTOMATIC DECISION |
| | SECOND AUTOMATIC DECISION |
| | THIRD AUTOMATIC DECISION |
| DYNAMIC DECISION MODE | FIRST DYNAMIC DECISION |
| | SECOND DYNAMIC DECISION |
| | THIRD DYNAMIC DECISION |
| MIXTURE MODE | |
| NON-DESIGNATION MODE | |

FIG. 6

SETTING FOR ASSIGNMENT MODE

| | STACKING UNIT 65a | STACKING UNIT 65b | STACKING UNIT 65c | STACKING UNIT 65d | STACKING UNIT 65e | STACKING UNIT 65f | STACKING UNIT 65g | STACKING UNIT 65h |
|---|---|---|---|---|---|---|---|---|
| CURRENCY | DESIGNATION /$ | DESIGNATION /$ | DESIGNATION /$ | DESIGNATION /€ | SECOND DYNAMIC | MIXTURE | MIXTURE | MIXTURE |
| DENOMINATION | DESIGNATION /100 | FIRST AUTOMATIC | FIRST AUTOMATIC | FIRST AUTOMATIC | SECOND DYNAMIC | MIXTURE | MIXTURE | MIXTURE |
| VERSION | DESIGNATION /NEW | DESIGNATION /NEW | DESIGNATION /OLD | DESIGNATION /NEW | DESIGNATION /NEW | MIXTURE | MIXTURE | MIXTURE |
| ORIENTATION | FIRST AUTOMATIC | FIRST AUTOMATIC | FIRST AUTOMATIC | FIRST AUTOMATIC | FIRST AUTOMATIC | MIXTURE | MIXTURE | MIXTURE |
| FITNESS | DESIGNATION /FIT | DESIGNATION /FIT | DESIGNATION /FIT | DESIGNATION /FIT | DESIGNATION /FIT | DESIGNATION /FIT | DESIGNATION /FIT | DESIGNATION /UNFIT |

FIG. 7

KIND OF BANKNOTES TO BE STACKED

| | STACKING UNIT 65a | STACKING UNIT 65b | STACKING UNIT 65c | STACKING UNIT 65d | STACKING UNIT 65e | STACKING UNIT 65f | STACKING UNIT 65g | STACKING UNIT 65h |
|---|---|---|---|---|---|---|---|---|
| CURRENCY | $ | $ | $ | € | | MIXTURE | MIXTURE | MIXTURE |
| DENOMINATION | 100 | | | | | MIXTURE | MIXTURE | MIXTURE |
| VERSION | NEW BANKNOTE | NEW BANKNOTE | OLD BANKNOTE | NEW BANKNOTE | NEW BANKNOTE | MIXTURE | MIXTURE | MIXTURE |
| ORIENTATION | | | | | | MIXTURE | MIXTURE | MIXTURE |
| FITNESS | FIT BANKNOTE | FIT BANKNOTE | FIT BANKNOTE | FIT BANKNOTE | FIT BANKNOTE | FIT BANKNOTE | FIT BANKNOTE | UNFIT BANKNOTE |

FIG. 8

KIND OF BANKNOTES TO BE STACKED

| | STACKING UNIT 65a | STACKING UNIT 65b | STACKING UNIT 65c | STACKING UNIT 65d | STACKING UNIT 65e | STACKING UNIT 65f | STACKING UNIT 65g | STACKING UNIT 65h |
|---|---|---|---|---|---|---|---|---|
| CURRENCY | $ | $ | $ | € | | MIXTURE | MIXTURE | MIXTURE |
| DENOMINATION | 100 | 20 | 20 | | | MIXTURE | MIXTURE | MIXTURE |
| VERSION | NEW BANKNOTE | NEW BANKNOTE | OLD BANKNOTE | NEW BANKNOTE | NEW BANKNOTE | MIXTURE | MIXTURE | MIXTURE |
| ORIENTATION | | | | | | MIXTURE | MIXTURE | MIXTURE |
| FITNESS | FIT BANKNOTE | FIT BANKNOTE | FIT BANKNOTE | FIT BANKNOTE | FIT BANKNOTE | FIT BANKNOTE | FIT BANKNOTE | UNFIT BANKNOTE |

FIG. 9

KIND OF BANKNOTES TO BE STACKED

| | STACKING UNIT 65a | STACKING UNIT 65b | STACKING UNIT 65c | STACKING UNIT 65d | STACKING UNIT 65e | STACKING UNIT 65f | STACKING UNIT 65g | STACKING UNIT 65h |
|---|---|---|---|---|---|---|---|---|
| CURRENCY | $ | $ | $ | € | ¥ | MIXTURE | MIXTURE | MIXTURE |
| DENOMINATION | 100 | 20 | 20 | | 1000 | MIXTURE | MIXTURE | MIXTURE |
| VERSION | NEW BANKNOTE | NEW BANKNOTE | OLD BANKNOTE | NEW BANKNOTE | NEW BANKNOTE | MIXTURE | MIXTURE | MIXTURE |
| ORIENTATION | FACE-UP AND PORTRAIT-UP | FACE-UP AND PORTRAIT-UP | FACE-UP AND PORTRAIT-UP | FACE-UP AND PORTRAIT-UP | FACE-UP AND PORTRAIT-UP | MIXTURE | MIXTURE | MIXTURE |
| FITNESS | FIT BANKNOTE | FIT BANKNOTE | FIT BANKNOTE | FIT BANKNOTE | FIT BANKNOTE | FIT BANKNOTE | FIT BANKNOTE | UNFIT BANKNOTE |

FIG. 10

KIND OF BANKNOTES TO BE STACKED

| | STACKING UNIT 65a | STACKING UNIT 65b | STACKING UNIT 65c | STACKING UNIT 65d | STACKING UNIT 65e | STACKING UNIT 65f | STACKING UNIT 65g | STACKING UNIT 65h |
|---|---|---|---|---|---|---|---|---|
| CURRENCY | $ | $ | $ | € | ¥ | MIXTURE | MIXTURE | MIXTURE |
| DENOMINATION | 100 | 20 | 20 | 200 | 1000 | MIXTURE | MIXTURE | MIXTURE |
| VERSION | NEW BANKNOTE | NEW BANKNOTE | OLD BANKNOTE | NEW BANKNOTE | NEW BANKNOTE | MIXTURE | MIXTURE | MIXTURE |
| ORIENTATION | FACE-UP AND PORTRAIT-UP | FACE-UP AND PORTRAIT-UP | FACE-UP AND PORTRAIT-UP | FACE-UP AND PORTRAIT-UP | FACE-UP AND PORTRAIT-UP | MIXTURE | MIXTURE | MIXTURE |
| FITNESS | FIT BANKNOTE | FIT BANKNOTE | FIT BANKNOTE | FIT BANKNOTE | FIT BANKNOTE | FIT BANKNOTE | FIT BANKNOTE | UNFIT BANKNOTE |

FIG. 11

KIND OF BANKNOTES TO BE STACKED

| | STACKING UNIT 65a | STACKING UNIT 65b | STACKING UNIT 65c | STACKING UNIT 65d | STACKING UNIT 65e | STACKING UNIT 65f | STACKING UNIT 65g | STACKING UNIT 65h |
|---|---|---|---|---|---|---|---|---|
| CURRENCY | $ | $ | $ | € | | MIXTURE | MIXTURE | MIXTURE |
| DENOMINATION | 100 | 20 | 20 | 200 | | MIXTURE | MIXTURE | MIXTURE |
| VERSION | NEW BANKNOTE | NEW BANKNOTE | OLD BANKNOTE | NEW BANKNOTE | NEW BANKNOTE | MIXTURE | MIXTURE | MIXTURE |
| ORIENTATION | FACE-UP AND PORTRAIT-UP | FACE-UP AND PORTRAIT-UP | FACE-UP AND PORTRAIT-UP | FACE-UP AND PORTRAIT-UP | FACE-UP AND PORTRAIT-UP | MIXTURE | MIXTURE | MIXTURE |
| FITNESS | FIT BANKNOTE | FIT BANKNOTE | FIT BANKNOTE | FIT BANKNOTE | FIT BANKNOTE | FIT BANKNOTE | FIT BANKNOTE | UNFIT BANKNOTE |

FIG. 12

KIND OF BANKNOTES TO BE STACKED

| | STACKING UNIT 65a | STACKING UNIT 65b | STACKING UNIT 65c | STACKING UNIT 65d | STACKING UNIT 65e | STACKING UNIT 65f | STACKING UNIT 65g | STACKING UNIT 65h |
|---|---|---|---|---|---|---|---|---|
| CURRENCY | $ | $ | $ | € | ¥ | MIXTURE | MIXTURE | MIXTURE |
| DENOMINATION | 100 | 20 | 20 | 200 | 5000 | MIXTURE | MIXTURE | MIXTURE |
| VERSION | NEW BANKNOTE | NEW BANKNOTE | OLD BANKNOTE | NEW BANKNOTE | NEW BANKNOTE | MIXTURE | MIXTURE | MIXTURE |
| ORIENTATION | FACE-UP AND PORTRAIT-UP | FACE-UP AND PORTRAIT-UP | FACE-UP AND PORTRAIT-UP | FACE-UP AND PORTRAIT-UP | FACE-UP AND PORTRAIT-UP | MIXTURE | MIXTURE | MIXTURE |
| FITNESS | FIT BANKNOTE | FIT BANKNOTE | FIT BANKNOTE | FIT BANKNOTE | FIT BANKNOTE | FIT BANKNOTE | FIT BANKNOTE | UNFIT BANKNOTE |

FIG. 13

SETTING FOR ASSIGNMENT MODE

| | STACKING UNIT 65a | STACKING UNIT 65b | STACKING UNIT 65c | STACKING UNIT 65d | STACKING UNIT 65e | STACKING UNIT 65f | STACKING UNIT 65g | STACKING UNIT 65h |
|---|---|---|---|---|---|---|---|---|
| CURRENCY | DESIGNATION / $ | DESIGNATION / $ | DESIGNATION / $ | DESIGNATION / $ | FIRST AUTOMATIC | FIRST AUTOMATIC | SECOND AUTOMATIC | SECOND AUTOMATIC |
| DENOMINATION | DESIGNATION /100 | DESIGNATION /50 | DESIGNATION /10 | MIXTURE | FIRST AUTOMATIC | SECOND AUTOMATIC | FIRST AUTOMATIC | SECOND AUTOMATIC |

FIG. 14

KIND OF BANKNOTES TO BE STACKED

| | STACKING UNIT 65a | STACKING UNIT 65b | STACKING UNIT 65c | STACKING UNIT 65d | STACKING UNIT 65e | STACKING UNIT 65f | STACKING UNIT 65g | STACKING UNIT 65h |
|---|---|---|---|---|---|---|---|---|
| CURRENCY | $ | $ | $ | $ | € | € | | |
| DENOMINATION | 100 | 50 | 10 | MIXTURE | 20 | | | |

FIG. 15

KIND OF BANKNOTES TO BE STACKED

| | STACKING UNIT 65a | STACKING UNIT 65b | STACKING UNIT 65c | STACKING UNIT 65d | STACKING UNIT 65e | STACKING UNIT 65f | STACKING UNIT 65g | STACKING UNIT 65h |
|---|---|---|---|---|---|---|---|---|
| CURRENCY | $ | $ | $ | $ | € | € | ¥ | ¥ |
| DENOMINATION | 100 | 50 | 10 | MIXTURE | 20 | | 1000 | |

F I G. 16

KIND OF BANKNOTES TO BE STACKED

| | STACKING UNIT 65a | STACKING UNIT 65b | STACKING UNIT 65c | STACKING UNIT 65d | STACKING UNIT 65e | STACKING UNIT 65f | STACKING UNIT 65g | STACKING UNIT 65h |
|---|---|---|---|---|---|---|---|---|
| CURRENCY | $ | $ | $ | $ | € | € | ¥ | ¥ |
| DENOMINATION | 100 | 50 | 10 | MIXTURE | 20 | | 1000 | 5000 |

FIG. 17

KIND OF BANKNOTES TO BE STACKED

| | STACKING UNIT 65a | STACKING UNIT 65b | STACKING UNIT 65c | STACKING UNIT 65d | STACKING UNIT 65e | STACKING UNIT 65f | STACKING UNIT 65g | STACKING UNIT 65h |
|---|---|---|---|---|---|---|---|---|
| CURRENCY | $ | $ | $ | $ | € | € | ¥ | ¥ |
| DENOMINATION | 100 | 50 | 10 | MIXTURE | 20 | 200 | 1000 | 5000 |

FIG. 18

SETTING FOR ASSIGNMENT MODE

| | STACKING UNIT 65a | STACKING UNIT 65b | STACKING UNIT 65c | STACKING UNIT 65d | STACKING UNIT 65e | STACKING UNIT 65f | STACKING UNIT 65g | STACKING UNIT 65h |
|---|---|---|---|---|---|---|---|---|
| CURRENCY | FIRST AUTOMATIC | FIRST AUTOMATIC | FIRST AUTOMATIC | SECOND AUTOMATIC | SECOND AUTOMATIC | THIRD AUTOMATIC | THIRD AUTOMATIC | MIXTURE |
| DENOMINATION | FIRST AUTOMATIC | SECOND AUTOMATIC | THIRD AUTOMATIC | FIRST AUTOMATIC | SECOND AUTOMATIC | FIRST AUTOMATIC | SECOND DYNAMIC | MIXTURE |

FIG. 19

KIND OF BANKNOTES TO BE STACKED

| | STACKING UNIT 65a | STACKING UNIT 65b | STACKING UNIT 65c | STACKING UNIT 65d | STACKING UNIT 65e | STACKING UNIT 65f | STACKING UNIT 65g | STACKING UNIT 65h |
|---|---|---|---|---|---|---|---|---|
| CURRENCY | $ | $ | $ | | | | | MIXTURE |
| DENOMINATION | 50 | | | | | | | MIXTURE |

F I G. 20

KIND OF BANKNOTES TO BE STACKED

| | STACKING UNIT 65a | STACKING UNIT 65b | STACKING UNIT 65c | STACKING UNIT 65d | STACKING UNIT 65e | STACKING UNIT 65f | STACKING UNIT 65g | STACKING UNIT 65h |
|---|---|---|---|---|---|---|---|---|
| CURRENCY | $ | $ | $ | | | | | MIXTURE |
| DENOMINATION | 50 | 20 | | | | | | MIXTURE |

F I G. 21

KIND OF BANKNOTES TO BE STACKED

| | STACKING UNIT 65a | STACKING UNIT 65b | STACKING UNIT 65c | STACKING UNIT 65d | STACKING UNIT 65e | STACKING UNIT 65f | STACKING UNIT 65g | STACKING UNIT 65h |
|---|---|---|---|---|---|---|---|---|
| CURRENCY | $ | $ | $ | € | € | | | MIXTURE |
| DENOMINATION | 50 | 20 | | 20 | | | | MIXTURE |

F I G. 22

KIND OF BANKNOTES TO BE STACKED

| | STACKING UNIT 65a | STACKING UNIT 65b | STACKING UNIT 65c | STACKING UNIT 65d | STACKING UNIT 65e | STACKING UNIT 65f | STACKING UNIT 65g | STACKING UNIT 65h |
|---|---|---|---|---|---|---|---|---|
| CURRENCY | $ | $ | $ | € | € | ¥ | ¥ | MIXTURE |
| DENOMINATION | 50 | 20 | | 20 | | 1000 | | MIXTURE |

F I G. 23

KIND OF BANKNOTES TO BE STACKED

| | STACKING UNIT 65a | STACKING UNIT 65b | STACKING UNIT 65c | STACKING UNIT 65d | STACKING UNIT 65e | STACKING UNIT 65f | STACKING UNIT 65g | STACKING UNIT 65h |
|---|---|---|---|---|---|---|---|---|
| CURRENCY | $ | $ | $ | € | € | ¥ | ¥ | MIXTURE |
| DENOMINATION | 50 | 20 | 1 | 20 | | 1000 | | MIXTURE |

F I G. 24

KIND OF BANKNOTES TO BE STACKED

| | STACKING UNIT 65a | STACKING UNIT 65b | STACKING UNIT 65c | STACKING UNIT 65d | STACKING UNIT 65e | STACKING UNIT 65f | STACKING UNIT 65g | STACKING UNIT 65h |
|---|---|---|---|---|---|---|---|---|
| CURRENCY | $ | $ | $ | € | € | ¥ | ¥ | MIXTURE |
| DENOMINATION | 50 | 20 | 1 | 20 | | 1000 | 5000 | MIXTURE |

F I G. 25

KIND OF BANKNOTES TO BE STACKED

| | STACKING UNIT 65a | STACKING UNIT 65b | STACKING UNIT 65c | STACKING UNIT 65d | STACKING UNIT 65e | STACKING UNIT 65f | STACKING UNIT 65g | STACKING UNIT 65h |
|---|---|---|---|---|---|---|---|---|
| CURRENCY | $ | $ | $ | € | € | ¥ | ¥ | MIXTURE |
| DENOMINATION | 50 | 20 | 1 | 20 | 200 | 1000 | 5000 | MIXTURE |

F I G. 26

KIND OF BANKNOTES TO BE STACKED

| | STACKING UNIT 65a | STACKING UNIT 65b | STACKING UNIT 65c | STACKING UNIT 65d | STACKING UNIT 65e | STACKING UNIT 65f | STACKING UNIT 65g | STACKING UNIT 65h |
|---|---|---|---|---|---|---|---|---|
| CURRENCY | $ | $ | $ | € | € | ¥ | ¥ | MIXTURE |
| DENOMINATION | 50 | 20 | 1 | 20 | 200 | 1000 | | MIXTURE |

FIG. 27

KIND OF BANKNOTES TO BE STACKED

| | STACKING UNIT 65a | STACKING UNIT 65b | STACKING UNIT 65c | STACKING UNIT 65d | STACKING UNIT 65e | STACKING UNIT 65f | STACKING UNIT 65g | STACKING UNIT 65h |
|---|---|---|---|---|---|---|---|---|
| CURRENCY | $ | $ | $ | € | € | ¥ | ¥ | MIXTURE |
| DENOMINATION | 50 | 20 | 1 | 20 | 200 | 1000 | 10000 | MIXTURE |

F I G. 28

BANKNOTE HANDLING MACHINE

CROSS REFERENCE TO RELATED APPLICATION

This application is based upon and claims benefit of priority from the Japanese Patent Application No. 2012-40026, filed on Feb. 27, 2012, the entire contents of which are incorporated herein by reference.

FIELD OF THE INVENTION

The present invention relates to a banknote handling machine configured to sort and stack banknotes.

BACKGROUND OF THE INVENTION

In general, a banknote handling machine includes a plurality of stacking units, and is used for sorting banknotes, for each denomination of money and/or each currency of the banknotes, and then stacking such sorted banknotes in each corresponding stacking unit. For instance, the banknote handling machine disclosed in Patent Document 1 includes four stacking units and is designed for storing a plurality of sorting patterns. In this case, when one sorting pattern is designated, among such a plurality of sorting patterns, the banknote handling machine can serve to sort and stack the banknotes, for each denomination of money thereof, in the four stacking units, as well as serve to sort and stack the banknotes of a particular denomination of money, with each of such banknotes being oriented in a certain orientation, in the four stacking units. Further, this banknote handling machine can serve to stack the banknotes of the denomination of money that is first recognized, in the four stacking units.

Today, various methods are known for sorting the currency and denomination of money of the banknotes that are inserted or deposited into the banknote handling machine and/or sorting the banknotes that have been inserted or deposited in the banknote handling machine. However, such known methods are usually provided to designate any one of the sorting patterns that have been stored, in advance, in the banknote handling machine, and thus may tend to unduly limit the degree of freedom or flexibility in setting or assignment concerning the banknotes to be stacked in each stacking unit. Therefore, in some cases, such methods may not adequately respond to the users' needs. In particular, as the number of the stacking units provided in the banknote handling machine is increased, a higher freedom or flexibility is required in the setting for each stacking unit.

Patent Document 1: WO2008/096430A1

SUMMARY OF THE INVENTION

According to one aspect of the present invention, there is provided a banknote handling machine including a take-in unit configured to take in a plurality of banknotes, one by one, a recognition unit configured to recognize a kind of each banknote taken in by the take-in unit, a plurality of stacking units, respectively configured to stack therein the banknotes, a transport unit configured to transport the banknotes, respectively recognized by the recognition unit, to any of the plurality of stacking units, an instruction accepting unit configured to accept an instruction concerning an automatic decision mode provided for deciding the kind of the banknotes to be stacked, by utilizing a recognition result obtained by the recognition unit, for each of the plurality of stacking units, and a control unit configured to control the transport unit to transport each banknote to a destination, which destination is decided based on the instruction accepted by the instruction accepting unit and on the recognition result obtained by the recognition unit.

BRIEF DESCRIPTION OF THE DRAWINGS

FIG. 5 is a diagram for showing one example of setting for an assignment mode concerning the currency.

FIG. 6 is a diagram for showing one example of the setting for the assignment mode concerning the denomination of money.

FIG. 7 is a diagram for showing one example of the setting for the assignment mode.

FIG. 8 is a diagram for showing one example of decision for the kind or sort of the banknotes to be stacked.

FIG. 9 is a diagram for showing another example of the decision for the kind or sort of the banknotes to be stacked.

FIG. 10 is a diagram for showing still another example of the decision for the kind or sort of the banknotes to be stacked.

FIG. 11 is a diagram for showing still yet another example of the decision for the kind or sort of the banknotes to be stacked.

FIG. 12 is a diagram for showing still yet another example of the decision for the kind or sort of the banknotes to be stacked.

FIG. 13 is a diagram for showing still yet another example of the decision for the kind or sort of the banknotes to be stacked.

FIG. 14 is a diagram for showing another example of the setting for the assignment mode.

FIG. 15 is a diagram for showing another example of the decision for the kind or sort of the banknotes to be stacked.

FIG. 16 is a diagram for showing still another example of the decision for the kind or sort of the banknotes to be stacked.

FIG. 17 is a diagram for showing still yet another example of the decision for the kind or sort of the banknotes to be stacked.

FIG. 18 is a diagram for showing still yet another example of the decision for the kind or sort of the banknotes to be stacked.

FIG. 19 is a diagram for showing still another example of the setting for the assignment mode.

FIG. 20 is a diagram for showing another example of the decision for the kind or sort of the banknotes to be stacked.

FIG. 21 is a diagram for showing still another example of the decision for the kind or sort of the banknotes to be stacked.

FIG. 22 is a diagram for showing still yet another example of the decision for the kind or sort of the banknotes to be stacked.

FIG. 23 is a diagram for showing still yet another example of the decision for the kind or sort of the banknotes to be stacked.

FIG. 24 is a diagram for showing still yet another example of the decision for the kind or sort of the banknotes to be stacked.

FIG. 25 is a diagram for showing still yet another example of the decision for the kind or sort of the banknotes to be stacked.

FIG. 26 is a diagram for showing still yet another example of the decision for the kind or sort of the banknotes to be stacked.

FIG. 27 is a diagram for showing still yet another example of the decision for the kind or sort of the banknotes to be stacked.

FIG. 28 is a diagram for showing still yet another example of the decision for the kind or sort of the banknotes to be stacked.

DETAILED DESCRIPTION

Hereinafter, one exemplary embodiment of the present invention will be described with reference to the drawings.

Figure 1:
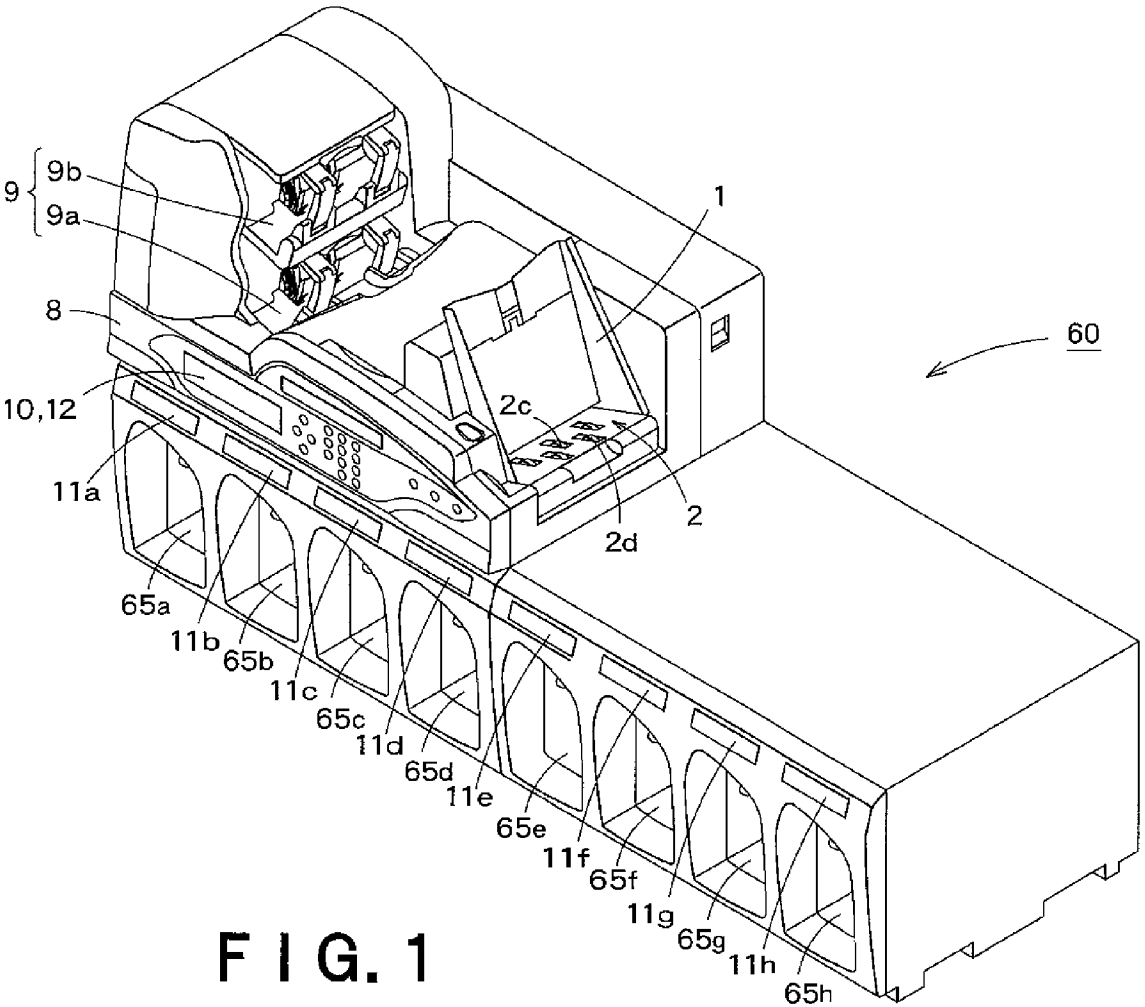
FIG. 1 is a perspective view of the banknote handling machine related to one embodiment of the present invention.
Figure 2:
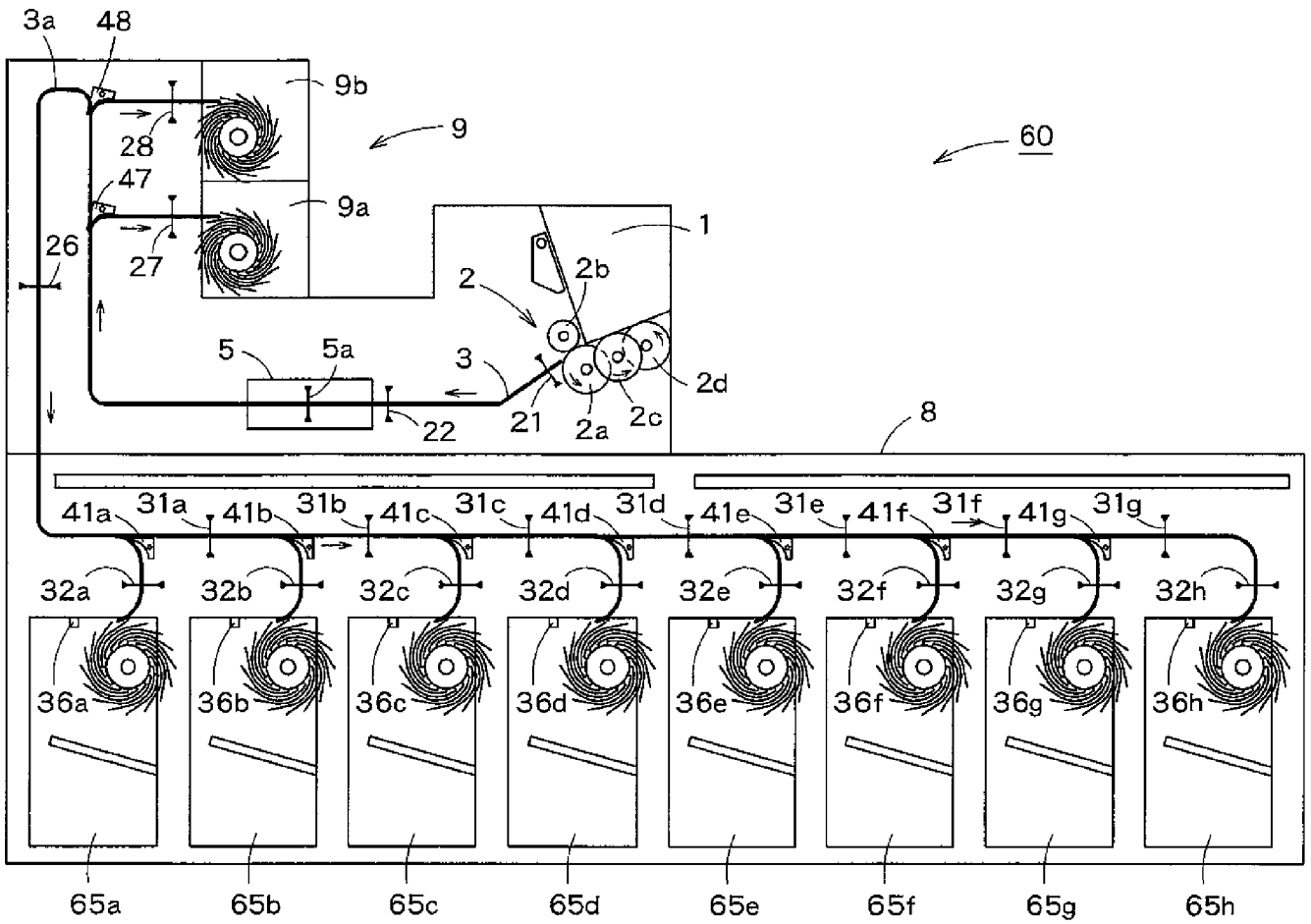
FIG. 2 is a cross section taken parallel to a front view of the banknote handling machine related to the embodiment shown in FIG. 1.
Figure 3:
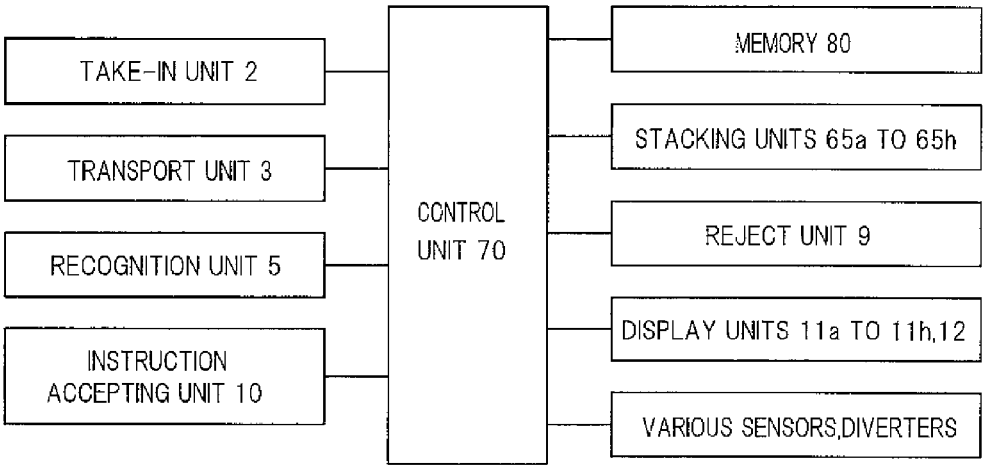
FIG. 3 is a block diagram for illustrating the banknote handling machine related to the embodiment shown in FIG. 1.

FIG. 1 shows one perspective view of the banknote handling machine related to the embodiment of the present invention, and FIG. 2 shows one cross section taken parallel to the front view of the banknote handling machine shown in FIG. 1. FIG. 3 shows one block diagram for illustrating the banknote handling machine of this embodiment.

As shown in FIGS. 1 and 2, the banknote handling machine 60 includes a casing 8, a hopper (or reception unit) 1, a take-in unit 2, a transport unit 3, and a recognition unit 5. The hopper 1 is provided to the casing 8 and adapted for receiving the banknotes in a batch form. The take-in unit 2 is adapted for taking the banknotes received in the batch form in the hopper 1, one by one, into the casing 8. The transport unit 3 is adapted for transporting the banknotes respectively taken in the casing 8 by the take-in unit 2. The recognition unit 5 is provided to the transport unit 3 and adapted for recognizing each banknote transported by the transport unit 3.

More specifically, as shown in FIG. 2, the take-in unit 2 includes a feed roller 2*a* adapted for feeding the banknotes, a gate roller (or reversal roller) 2*b* provided to be opposite to the feed roller 2*a*, and kicker rollers 2*c*, 2*d*, respectively adapted for feeding each banknote received in the hopper 1 toward the feed roller 2*a*. The transport unit 3 includes a transport path 3*a* adapted for guiding the banknotes, and a transport roller (not shown) adapted for providing some driving force to each of the guided banknotes.

Further, as shown in FIG. 2, transport-condition sensors 21, 22, respectively adapted for detecting the transport condition of each banknote taken in the casing 8 by the take-in unit 2, are provided between the take-in unit 2 and the recognition unit 5. The recognition unit 5 includes an image-reading sensor 5*a* adapted for reading an image of each banknote guided along the transport path 3*a*. In this case, the recognition unit 5 can serve to recognize the currency, denomination, orientation, fitness, version (edition number or newness), authenticity or the like of each banknote, based on each image data read by the image-reading sensor 5*a*.

A reject unit 9 is connected with one end of the transport unit 3 located on the downstream side relative to the recognition unit 5. The reject unit 9 is provided for stacking therein the banknotes respectively judged not to be stacked in any of the stacking units 65*a* to 65*h*. This reject unit 9 includes a first reject unit 9*a* located in a lower position and a second reject unit 9*b* located in an upper position.

For instance, the first reject unit 9*a* is provided for stacking therein the banknotes respectively judged as ones involved in some recognition error and/or transport error. Meanwhile, the second reject unit 9*b* is provided for stacking therein the banknotes respectively judged, as counterfeit banknotes, upon the recognition or judgment on the authenticity performed by the recognition unit 5.

Herein, the "transport error" means some error seen upon the transportation for each banknote performed by the transport unit 3. For instance, this transport error includes oblique transportation in which some banknote (or banknotes) is transported in an oblique state, overlap transportation in which some banknotes are transported while being overlapped one on another, and chain transportation in which some banknotes are transported without any interval therebetween.

In addition, as shown in FIG. 2, diverters 47, 48, respectively adapted for switching the reject unit 9 (i.e., the first reject unit 9*a* and second reject unit 9*b*) for guiding the banknotes, are provided to the transport path 3*a*.

One sensor 27 is provided between the diverter 47 and the first reject unit 9*a*. This sensor 27 can serve to detect whether or not each banknote guided by the diverter 47 is normally guided to the first reject unit 9*a*. Similarly, another sensor 28 is provided between the diverter 48 and the second reject unit 9*b*. This sensor 28 can serve to detect whether or not each banknote guided by the diverter 48 is normally guided to the second reject unit 9*b*.

Further, as shown in FIGS. 1 and 2, the stacking units 65*a* to 65*h*, respectively adapted for stacking therein the banknotes respectively transported by the transport unit 3, are connected with the one end of the transport unit 3 located on the downstream side relative to the recognition unit 5.

Additionally, as shown in FIG. 2, another sensor 26 is provided between the diverter 48 and the stacking unit 65*a*. This sensor 26 can serve to detect whether or not each banknote that is not guided to the reject unit 9 is normally guided toward the stacking units 65*a* to 65*h*.

Furthermore, other sensors 31*a* to 31*g*, respectively adapted for detecting whether or not each banknote is normally transported, and/or other diverters 41*a* to 41*g*, respectively adapted for switching the stacking units to which the banknotes are respectively guided, are provided to the transport path 3*a*. In addition, count sensors 32*a* to 32*h* are provided on the downstream side relative to the diverters 41*a* to 41*g*, respectively. Each of the count sensors 32*a* to 32*h* can serve to detect whether or not each banknote diverted by the diverters 41*a* to 41*g* is normally guided to the stacking units 65*a* to 65*h*.

Further, residue sensors 36*a* to 36*h*, respectively adapted for detecting the storage condition of the banknotes in the stacking units 65*a* to 65*b*, are provided in the stacking units 65*a* to 65*b*, respectively.

Now, returning to FIG. 1, display units 11*a* to 11*h*, respectively adapted for displaying the kind and/or number of the banknotes respectively stacked in the stacking units 65*a* to 65*h*, are provided to the casing 8. For instance, the kind or sort of the banknotes displayed on each of the display units 11*a* to 11*h* includes the currency, denomination, orientation, fitness, version (edition number or newness) or the like of each banknote. Herein, the orientation includes four orientations, i.e., a face-up and portrait-up orientation, a face-up and portrait-down orientation, a face-down and portrait-up orientation, and a face-down and portrait-down orientation. More specifically, the face-up and portrait-up orientation is the orientation that the banknote is taken in the banknote handling machine, with the portrait of this banknote facing upward and being taken in from the head thereof. The face-up and portrait-down orientation is the orientation that the banknote is taken in the banknote handling machine, with the portrait of this banknote facing upward and being taken in the opposite direction to the head thereof. The face-down and portrait-up orientation is the orientation that the banknote is taken in the banknote handling machine, with the portrait of this banknote facing downward and being taken in from the head thereof. The face-down and portrait-down orientation is the orientation that the banknote is taken in the banknote handling machine, with the portrait of this banknote facing downward and being taken in the opposite direction to the head thereof.

Each of the display units 11*a* to 11*h* may be any suitable display device, such as an LCD or the like, or otherwise may be any suitable combination of a printed letter and a light emission element.

Further, as shown in FIG. 1, one instruction accepting unit 10 is provided to the casing 8. This instruction accepting unit 10 is adapted for accepting an instruction for setting the assignment mode concerning the banknotes that will be respectively stacked in the stacking units 65*a* to 65*h*. For instance, the instruction accepting unit 10 is provided as a touch panel.

Now, the assignment mode concerning the banknotes to be respectively stacked in the stacking units 65*a* to 65*h* will be described. Herein, the "assignment mode" means a way of assigning the banknotes to be respectively stacked, and includes a designation mode, an automatic decision mode, a mixture mode, and a non-designation mode. Further, in the case of the banknote handling machine 60 of this embodiment, the automatic decision mode includes first to third automatic decision modes and first to third dynamic decision modes. Thus, as shown in the following Table 1, the assignment mode provided herein includes the designation mode, first to third automatic decision modes, first to third dynamic decision modes, mixture mode and non-designation mode. Each of the first to third automatic decision modes and first to third dynamic decision modes is one kind of the automatic decision mode. However, such first to third automatic decision modes and first to third dynamic decision modes are used differently, depending on a procedure for assigning the kind or sort of the banknotes to be stacked and/or on the timing at which the assigned kind or sort is cleared. For each of the stacking unit 65*a* to 65*h*, any one of the designation mode, first to third automatic decision modes, first to third dynamic decision modes, mixture mode and non-designation mode can be set, concerning the currency, denomination of money, orientation, fitness, version or the like of the banknotes to be stacked.

TABLE 1

| Assignment mode | Degree of preference |
|---|---|
| Designation mode | 5 |
| First to third automatic decision modes | 4 |
| First to third dynamic decision modes | 3 |
| Mixture mode | 2 |
| Non-designation mode | 1 |

The designation mode is provided for designating the kind or sort of the banknotes to be stacked, and is the highest in the degree of preference. Specifically, in the designation mode, the currency and/or denomination of money of the banknotes to be stacked is designated (or specified) in advance. For instance, in the case in which the designation mode is set concerning the currency of the banknotes to be stacked, one of "dollar", "yen", "euro" and the like is designated. Meanwhile, in the case in which the designation mode is set concerning the denomination of money, it is necessary to set the designation mode concerning the currency and designate a certain currency of the banknotes to be stacked, before the setting concerning the denomination of money is performed. This is because the denomination of money that is issued varies with the currency. Accordingly, for instance, in the case in which the designation mode is set concerning the denomination of money and 100 dollar is designated, it is necessary to set the designation mode concerning the currency and designate the dollar as the currency, before the setting concerning the denomination of money and the designation for the 100 dollar.

The designation mode is the highest in the degree of preference. Therefore, each banknote of the kind or sort that is designated in the designation mode will be transported to a certain stacking unit for which the designation mode is set, preferentially, relative to any other stacking units. For instance, in the case in which the designation mode is set concerning the currency and the dollar is designated, respectively for the stacking unit 65*a*, dollar banknotes taken in the banknote handling machine 60 are transported to and stacked in the stacking unit 65*a*, preferentially, relative to any other stacking units 65*b* to 65*h*.

The setting for the designation mode is valid even after the handling for the banknotes for one transaction is ended, and is kept until another setting is inputted or instructed by the user. Herein, the "banknotes for one transaction" refer to the banknotes collected per totalization of money, and may be a certain batch of the banknotes received at a time in the hopper 1, or otherwise may be the total of some batches of the banknotes received several times in the hopper 1. For instance, when there is a limit in the number of the banknotes that can be received at a time in the hopper 1 and when the number of the banknotes handled for the totalization of money is considerably large, such banknotes are once separated into several batches, and then such separated batches of the banknotes will be put or inserted, several times, in the hopper 1. Thereafter, when the user pushes an approval button (not shown) for approving a count result and/or an ending button (not shown) for instructing the end of handling the banknotes, a certain instruction for ending the insertion operation for the banknotes for one transaction is inputted to the banknote handling machine 60.

Now, the first automatic decision mode, second automatic decision mode and third automatic decision mode, each being one kind of the automatic decision mode provided for assigning the kind or sort of the banknotes to be stacked, depending on a recognition result obtained from the recognition unit 5, will be discussed. In the first automatic decision mode, the kind or sort of the banknotes that is recognized first by the recognition unit 5 is set, as the kind or sort of the banknotes to be stacked, in the handling for the banknotes for one transaction. For instance, in the case in which the first automatic decision mode is set, concerning the currency, for the stacking unit 65*a*, and in which euro banknotes are recognized first by the recognition unit 5, the euro is assigned, as the currency of the banknotes to be stacked, to the stacking unit 65*a*, and thereafter each banknote that is recognized as the euro banknote will be transported to and stacked in the stacking unit 65*a*.

Alternatively, in the case in which the designation mode is set concerning the currency and the dollar is designated, respectively for the stacking unit 65*a*, and in which the first automatic decision mode is set, concerning the denomination of money, for this stacking unit 65*a*, the denomination of money of the dollar banknotes that is recognized first by the recognition unit 5 is assigned to the stacking unit 65*a*. For instance, in the case in which 100 dollar banknotes are recognized first by the recognition unit 5, the 100 dollar is assigned, as the denomination of money of the banknotes to be stacked, to the stacking unit 65*a*.

In the second automatic decision mode, the kind or sort of the banknotes that is recognized second by the recognition unit 5 is set as the kind or sort of the banknotes to be stacked, in the handling for the banknotes for one transaction. At this time, it is preferred that the kind or sort of the banknotes that is not set in the designation mode for any of the stacking units and is recognized first by the recognition unit 5 is already assigned to a certain stacking unit for which the first automatic decision mode is set. Further, it is preferred that the second automatic decision mode is set for one stacking unit, on condition that the first automatic decision mode is already set for any other stacking unit. For instance, in the case in which the first automatic decision mode is set, concerning the currency, for the stacking unit 65*a*, and in which the second automatic decision mode is set, concerning the currency, for the stacking unit 65*b*, and in which the euro banknotes are recognized first and then the dollar banknotes are recognized second, respectively by the recognition unit 5, the euro is assigned, as the currency of the banknotes to be stacked, to the stacking unit 65*a*, and the dollar is assigned, as the currency of the banknotes to be stacked, to the stacking unit 65*b*.

In the third automatic decision mode, the kind or sort of the banknotes that is recognized third by the recognition unit 5 is set as the kind or sort of the banknotes to be stacked, in the handling for the banknotes for one transaction. Herein, it should be appreciated that a fourth automatic decision mode, a fifth automatic decision mode or the like may be further set.

As is seen from the above Table 1, the degree of the preference of the first to third automatic decision modes is the second highest relative to the designation mode. Therefore, in the case in which a certain kind or sort of the banknotes is designated in the designation mode, another kind or sort than the certain kind of the banknotes to be stacked will be decided or assigned in any of the first to third automatic decision modes. For instance, in the case in which the designation mode is set concerning the currency and the dollar is designated, respectively for the stacking unit 65*a*, and in which the first automatic decision mode is set, concerning the currency, for the stacking unit 65*b*, and in which the dollar banknotes are recognized first by the recognition unit 5, such dollar banknotes are transported to the stacking unit 65*a*. Thereafter, when another currency than the dollar banknote is recognized first by the recognition unit 5, such recognized currency will be decided as the currency of the banknotes to be stacked in the stacking unit 65*b*.

Each of the first to third automatic decision modes may be set for two or more stacking units. For instance, in the case in which the first automatic decision mode is set, concerning the currency, for the stacking units 65*a* and 65*b*, and in which the euro banknotes are recognized first by the recognition unit 5, the euro is assigned, as the currency of the banknotes to be stacked, to the stacking unit 65*a* or 65*b*.

The kind or sort of the banknotes that is assigned, in the first to third automatic decision modes, to each of the stacking units 65*a* to 65*h* is cleared when the handling for the banknotes for one transaction is ended.

Now, the dynamic decision mode will be described. The dynamic decision mode is one kind of the automatic decision mode and is provided for assigning the kind or sort of the banknotes to be stacked, depending on the recognition result obtained from the recognition unit 5, during the handling for the banknotes. Unlike the first to third automatic decision modes, the assignment in the dynamic decision mode can be performed for any given banknotes, irrespectively of the order in which those banknotes are recognized. For instance, in the case in which a particular recognition factor (e.g., the currency, denomination, authentication, fitness or the like) is recognized for some banknotes and is not yet assigned to any one of the stacking units, and in which there is a certain stacking unit for which the dynamic decision mode is set, among the stacking units for which the assignment is not decided, such a particular recognition factor will be assigned to the certain stacking unit.

More specifically, in the case in which the dynamic decision mode is set, concerning the currency, for the stacking unit 65*h*, and in which the dollar and euro are respectively assigned, as the currency of the banknotes to be stacked, to the stacking units 65*a* to 65*g*, and in which ruble banknotes are recognized by the recognition unit 5, "ruble" will be assigned, as the currency of the banknotes to be stacked, to the stacking unit 65*h*.

The dynamic decision mode includes the first dynamic decision mode, second dynamic decision mode and third dynamic decision mode.

In the first dynamic decision mode, the assigned kind or sort of the banknotes to be stacked is kept until the handling for the banknotes for one transaction is ended, and then cleared when this handling is ended.

In the second dynamic decision mode, the assigned kind or sort of the banknotes to be stacked is cleared when the handling for the banknotes for one transaction is ended or when all of the banknotes are taken out from the stacking unit for which the second dynamic decision mode is set.

In the third dynamic decision mode, the dynamic decision mode can be set for two or more stacking units. In this case, once the kind or sort of the banknotes to be stacked is decided or determined in the way as described above, the decided kind or sort of the banknotes is assigned to all of such two or more stacking units. For instance, in the case in which the third automatic decision mode is set, concerning the currency, for the stacking units 65*f* to 65*h*, and in which the dollar is assigned, as the currency of the banknotes to be stacked, to the stacking units 65*a* to 65*e*, and in which the euro banknotes are recognized by the recognition unit 5, the euro is assigned, as the currency of the banknotes to be stacked, to the respective stacking units 65*f* to 65*h*. Thereafter, the kind or sort of the banknotes to be stacked that is assigned to such a plurality of stacking units will be cleared when the handling for the banknotes for one transaction is ended or when all of the banknotes are taken out from those stacking units.

Each of the dynamic decision modes is lower in the degree of preference than the first to third automatic decision modes. Although each of such dynamic decision modes can be set, independently, for each kind or sort of the banknotes, the setting for the dynamic decision mode concerning the denomination of money may be optionally restricted or controlled in the case in which the dynamic decision mode is set concerning the currency of the banknotes to be stacked. This is because the denomination of money cannot be decided before the currency to be stacked is determined.

Next, the mixture mode will be described. This mixture mode is provided for stacking the banknotes, irrespectively of the recognition factor thereof (e.g., the currency, denomination, authentication, fitness or the like). The mixture mode is lower in the degree of preference than the dynamic decision mode. Accordingly, in the stacking unit for which the mixture mode is set, the banknotes of such a kind or sort that is not stacked in any of the other stacking units, for which the kind or sort of the banknotes to be stacked is decided in the designation mode, automatic decision mode or dynamic decision mode, are stacked in a mixed state.

Now, the non-designation mode will be described. This non-designation mode is the lowest in the degree of preference. Namely, the stacking unit for which the non-designation mode is set is used for stacking therein the banknotes that are not stacked in any other stacking units.

As shown in FIG. 3, the banknote handling machine 60 includes a memory 80 provided for storing therein a program for instructing a computer about a sort decision algorithm prepared for deciding or determining the kind or sort of the banknotes to be stacked, in response to the aforementioned designation mode, automatic decision mode (including the first to third automatic decision modes and/or dynamic decision modes), mixture mode and non-designation mode. This memory 80 includes a ROM (Read Only Memory) and/or an HDD (Hard Disk Drive), each adapted for storing therein various programs and data respectively provided for controlling the banknote handling machine 60, and a RAM (Random Access Memory) or the like that can serve as a loading area provided for each program and/or a working area used for execution of the program.

Further, the banknote handling machine 60 includes a control unit 70 that is provided as an operation unit used for controlling the entire body of the banknote handling machine 60 by executing each program stored in the memory 80. Once receiving the instruction about the assignment mode set for the banknotes to be stacked in the stacking units 65*a* to 65*h*, via the instruction accepting unit 10, the control unit 70 serves to decide or determine the kind or sort of the banknotes to be stacked in the respective stacking unit 65*a* to 65*h*, by utilizing the recognition result obtained from the recognition unit 5, and then control each stacking unit or destination to which such banknotes will be transported.

Further, the control unit 70 can serve to drive each of the display units 11*a* to 11*h* to display the kind or sort of the banknotes to be stacked in the stacking units 65*a* to 65*h*. Once the handling for the banknotes for one transaction is ended, the control unit 70 outputs a totalization result (or count result). Then, the totalization result is displayed on another display unit 12 (see FIG. 1) provided to the casing 8, and/or outputted to an external computer.

Figure 4:
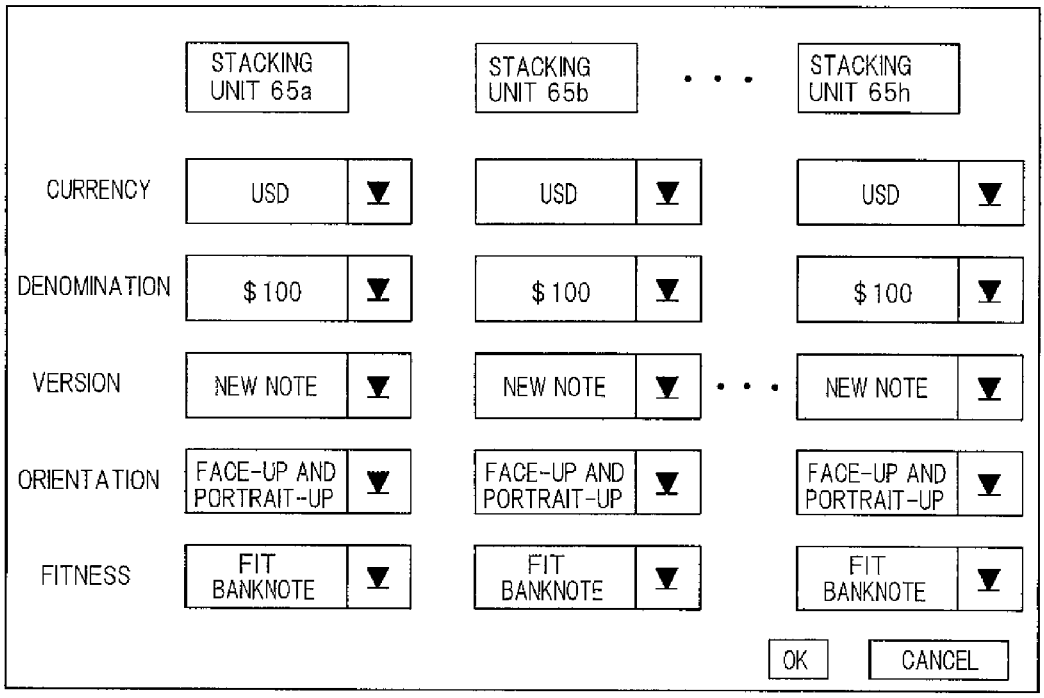
FIG. 4 is a diagram for showing one example of an instruction accepting unit provided in the banknote handling machine related to the embodiment shown in FIG. 1.

FIG. 4 shows one example of the instruction accepting unit 10. This instruction accepting unit 10 is provided as the touch panel, and is capable of setting the assignment mode, concerning the currency, denomination of money, version, orientation, fitness or the like of the banknotes, for each of the stacking units 65*a* to 65*h*.

For instance, when a currency key 101 as shown in FIG. 4 is pushed, a drop-down list as shown in FIG. 5 is displayed. From this drop-down list, a desired assignment mode is selected. As a result, if the designation mode is selected, a certain currency, such as dollar, euro or the like, is further selected.

Alternatively, when a denomination key 102 as shown in FIG. 4 is pushed, another drop-down list, as shown in FIG. 6, is displayed. Although all of the denominations of money that are respectively selectable can be displayed on the drop-down list, only the denomination of money of certain currency may be displayed in the case in which such currency is already set in the designation mode. FIG. 6 shows the drop-down list provided for selecting the denomination of money in the case in which the dollar is set, as the currency, in the designation mode. Then, from this drop-down list, a suitable assignment mode is selected. As a result, if the designation mode is selected, a certain denomination of money, such as 100 dollar, 50 dollar, 20 dollar or the like, is further selected.

Through the selections of the assignment mode as described above, concerning each of the currency, denomination of money, version, orientation, fitness or the like of the banknotes, for the respective stacking units 65*a* to 65*h*, the assignment mode will be finally set as shown in FIG. 7.

In the example shown in FIG. 7, the designation mode is set concerning the currency and the dollar is designated, respectively for the stacking unit 65*a*. Further, for this stacking unit 65*a*, the designation mode is set concerning the denomination of money and the 100 dollar is designated, respectively. Additionally, in this case, the designation mode is set concerning the version and the new (brand-new) banknote is designated, respectively. In addition, the first automatic decision mode is set concerning the orientation. Furthermore, the designation mode is set concerning the fitness and the fit banknote is designated, respectively.

For the stacking unit 65*b*, the designation mode is set concerning the currency and the dollar is designated, respectively. Further, in this case, the first automatic decision mode is set concerning the denomination of money. In addition, the designation mode is set concerning version and the new banknote is designated, respectively. Additionally, in this case, the first automatic decision mode is set concerning the orientation. Further, the designation mode is set concerning the fitness and the fit banknote is designated, respectively.

For the stacking unit 65*c*, as is similar to the stacking unit 65*b*, the designation mode is set concerning the currency and fitness, and the dollar and fit banknote are designated, respectively. Further, in this case, the first automatic designation mode is set concerning the denomination of money and orientation. In addition, the designation mode is set concerning the version and the old (brand-old) banknote is designated, respectively.

For the stacking unit 65*d*, the designation mode is set concerning the currency and the euro is designated, respectively. Further, in this case, the first automatic decision mode is set concerning the denomination of money. In addition, the designation mode is set concerning the version and the new banknote is designated, respectively. Additionally, in this case, the first automatic decision mode is set concerning the orientation. Furthermore, the designation mode is set concerning the fitness and the fit banknote is designated, respectively.

For the stacking unit 65*e*, the second dynamic decision mode is set concerning the currency and denomination of money. Further, in this case, the designation mode is set concerning the version and the new banknote is designated, respectively. In addition, the first automatic decision mode is set concerning the orientation. Further, the designation mode is set concerning the fitness and the fit banknote is designated, respectively.

For the stacking units 65*f* and 65*g*, the mixture mode is set concerning the currency, denomination of money, version (edition number or newness) and orientation. Further, in this case, the designation mode is set concerning the fitness and the fit banknote is designated, respectively.

Finally, for the stacking unit 65*h*, the mixture mode is set concerning the currency, denomination of money, version and orientation. Further, in this case, the designation mode is set concerning the fitness and the unfit banknote is designated, respectively.

Now, one example of a procedure for deciding or determining the kind or sort of the banknotes to be stacked, associated with the progress of the handling for the banknotes, in the case in which the setting for the assignment mode as shown in FIG. 7 is performed, will be described.

In this example, before the handling for the banknotes is started, the assignment of the kind or sort of the banknotes to be stacked, to the respective stacking units 65*a* to 65*h*, is set or determined as shown in FIG. 8. Each blank part shown in FIG. 8 expresses the kind or recognition factor (e.g., the currency, denomination, orientation, fitness or the like) that is not decided or determined at this point of time.

In the case in which the banknotes recognized first by the recognition unit 5 are new and fit 20-dollar banknotes, and in which the orientation of such banknotes is the face-up and portrait-up orientation, the assignment of the kind or sort of the banknotes to be stacked, to the respective stacking units 65*a* to 65*h*, will be set or determined as shown in FIG. 9. Namely, at the point of time shown in FIG. 8, there is no stacking unit for which the new and fit 20-dollar banknote oriented in the face-up and portrait-up orientation is designated. Then, a certain stacking unit, which is set in the automatic decision mode that is high, in the degree of preference, second to the designation mode, and thus will be capable of stacking therein such 20-dollar banknotes, is searched. As a result, it can be seen that the stacking unit 65*b* will be capable of stacking therein such 20-dollar banknotes, by setting the denomination of money at the 20 dollar as well as by setting the orientation of each banknote to be the face-up and portrait-up orientation, for this stacking unit 65*b*. Thus, the denomination of money is set at the 20 dollar and the orientation is set to be the face-up and portrait-up orientation, for the banknotes to be stacked in the stacking unit 65*b*. Namely, for each of the stacking units 65*b* and 65*c*, as shown in FIG. 7, the dollar is designated as the currency and the first automatic decision mode is set concerning the denomination of money, respectively. As such, the 20 dollar can be assigned, as the denomination of money of the banknotes to be stacked, to each of the stacking units 65*b* and 65*c*. Although the first automatic decision mode is also set for the stacking unit 65*d*, the 20 dollar cannot be set for the stacking unit 65*d* because the euro is already set, as the currency, for this stacking unit 65*d*. Further, in this example, as shown in FIG. 9, the face-up and portrait-up orientation is assigned, as the orientation of the banknotes to be stacked, to each of the stacking units 65*a* to 65*e*, for which the first automatic decision mode is set concerning the orientation.

Thereafter, in the case in which the banknotes recognized second by the recognition unit 5 are new and fit 100-dollar banknotes, and in which the orientation of the banknotes is the face-up and portrait-up orientation, such banknotes are stacked in the stacking unit 65*a*.

Further, in the case in which the banknotes recognized next by the recognition unit 5 are new and fit 1000-yen banknotes, and in which the orientation of such banknotes is the face-up and portrait-up orientation, the assignment of the kind or sort of the banknotes to be stacked, to the respective stacking units 65*a* to 65*h*, will be set or determined as shown in FIG. 10. Namely, at the point of time shown in FIG. 9, there is no stacking unit to which the yen is assigned as the currency for the banknotes to be stacked. However, it can be seen that the stacking unit 65*e* will be capable of stacking therein the 1000-yen banknotes, by setting the currency to be the yen as well as by setting the denomination of money at 1000 yen, for this stacking unit 65*e*. Thus, in this way, the 1000-yen banknote is assigned to the stacking unit 65*e*.

Subsequently, in the case in which the banknotes recognized by the recognition unit 5 are new and fit 200-euro banknotes, and in which the orientation of such banknotes is the face-up and portrait-up orientation, the assignment of the kind or sort of the banknotes to be stacked, to the respective stacking units 65*a* to 65*h* will be set or determined as shown in FIG. 11. Namely, at the point of time shown in FIG. 10, there is no stacking unit to which the 200-euro banknote is assigned. However, for the stacking unit 65*d*, the euro is set as the currency in the designation mode and the first automatic decision mode is set concerning the denomination of money, respectively. Therefore, by setting the denomination of money, at 200 euro, for the stacking unit 65*d*, this stacking unit 65*d* will be capable of stacking therein the 200-euro banknotes. Thus, the 200-euro is assigned, as the denomination of money of the banknotes to be stacked, to the stacking unit 65*d*.

In the handling for the banknotes that will be performed thereafter, the new and fit 100-dollar banknotes, respectively oriented in the face-up and portrait-up orientation, will be stacked in the stacking unit 65*a*. Meanwhile, the new and fit 20-dollar banknotes, respectively oriented in the face-up and portrait-up orientation, will be stacked in the stacking unit 65*b*. Further, the old and fit 20-dollar banknotes, respectively oriented in the face-up and portrait-up orientation, will be stacked in the stacking unit 65*c*. In addition, the new and fit 200-euro banknotes, respectively oriented in the face-up and portrait-up orientation, will be stacked in the stacking unit 65*d*. Furthermore, the new and fit 1000-yen banknotes, respectively oriented in the face-up and portrait-up orientation, will be stacked in the stacking unit 65*e*.

Among the banknotes that are not stacked in the respective stacking units 65*a* to 65*e*, the fit banknotes will be stacked in the stacking units 65*f* or 65*g*, respectively, while the unfit banknotes will be stacked in the stacking unit 65*h*. In addition, when the number of the banknotes stacked in each of the stacking units 65*a* to 65*e* reaches its upper limit, the destination to which the banknotes are transported will be changed or switched from the stacking units 65*a* to 65*e* to the stacking unit 65*f* or 65*g*.

Thereafter, when all of the banknotes stacked in the respective stacking units 65*a* to 65*h* are taken out therefrom, the assignment of the kind or sort of the banknotes to be stacked, to the respective stacking units 65*a* to 65*h* will be changed as shown in FIG. 12. Namely, since the assignment mode that has been set concerning the orientation and/or denomination of money for the respective stacking units 65*a* to 65*d* is the first automatic decision mode, the assignment concerning the denomination of money of the banknotes to be stacked and/or orientation of the banknotes to be stacked is kept even after the banknotes are taken out from each of such stacking units 65*a* to 65*d*. Meanwhile, since the assignment mode that has been set concerning the currency and/or denomination of money for the stacking unit 65*e* is the second automatic decision mode, the assignment concerning the currency of the banknotes to be stacked and/or denomination of money of the banknotes to be stacked is cleared, when the banknotes are taken out from this stacking unit 65*e*. However, since the assignment mode that has been set concerning the orientation for the stacking unit 65*e* is the first automatic decision mode, the assignment concerning the orientation of the banknotes to be stacked is kept even after the banknotes are taken out from the stacking unit 65*e*.

Further, in the case in which the banknotes recognized thereafter by the recognition unit 5 are new and fit 5000-yen banknotes, and in which the orientation of such banknotes is the face-up and portrait-up orientation, the assignment of the kind or sort of the banknotes to be stacked in the respective stacking units 65*a* to 65*h* is set or determined as shown in FIG. 13. Namely, at the point of time shown in FIG. 12, there is no stacking unit to which the yen is assigned as the currency for the banknotes to be stacked. Thus, the 5000-yen banknote will be assigned to the stacking unit 65*e*.

Now, another example of the setting for the assignment mode for the respective stacking units 65*h* to 65*h* and the procedure for deciding or determining the kind or sort of the banknotes to be stacked will be described. In this example, when the handling for the banknotes is started, the assignment mode is set, as shown in FIG. 14, for the respective stacking units 65*a* to 65*h*. For convenience, it is noted that the mixture mode is set concerning each of the version, orientation and fitness, and the explanation and illustration for such settings are omitted, respectively. Further, in this example, once the handling for the banknotes is started, the 50-dollar banknotes, 20-dollar banknotes, 20-euro banknotes, 1000-yen banknotes, 5000-yen banknotes, 200-euro banknotes and 10000-yen banknotes are taken in the banknote handling machine 60, respectively, in this order.

Namely, the 50-dollar banknotes, respectively taken in from the take-in unit 2 and then recognized by the recognition unit 5, are stacked first in the stacking unit 65*b*. Then, the 20-dollar banknotes are stacked in the stacking unit 65*d*.

Among the stacking units 65*a* to 65*d* at the point of time shown in FIG. 14, to which the currency or denomination of money is already assigned, there is no stacking unit that is capable of stacking therein the 20-euro banknotes. Therefore, once the 20-euro banknotes are recognized by the recognition unit 5, a certain stacking unit that will be capable of stacking therein the 20-euro banknotes is searched, among the stacking units for which the automatic decision mode that is high, in the degree of preference, second to the designation mode is set. As a result, it can be seen that two stacking units 65*e* and 65*f* are set, respectively, in the first automatic decision mode, concerning the currency. Thus, as shown in FIG. 15, the euro can be assigned, as the currency of the banknotes to be stacked, to such two stacking units 65*e* and 65*f*. In addition, since the first automatic decision mode is assigned, as the denomination of money, to the stacking unit 65*e*, "20 euro" is assigned, as the denomination of money of the banknotes to be stacked, to the stacking unit 65*e*.

Further, among the stacking units 65*a* to 65*d* at the point of time shown in FIG. 15, to which the currency or denomination of money is already assigned, there is no stacking unit that is capable of stacking therein the 1000-yen banknotes. Therefore, once the 1000-yen banknotes are recognized by the recognition unit 5, a certain stacking unit that will be capable of stacking therein the 1000-yen banknotes is searched, among the stacking units for which the automatic decision mode that is high, in the degree of preference, second to the first automatic decision mode is set. As a result, it can be seen that two stacking units 65*g* and 65*h* are set, respectively, in the second automatic decision mode, concerning the currency. Thus, as shown in FIG. 16, the yen can be assigned, as the currency of the banknotes to be stacked, to such two stacking units 65*g* and 65*h*. Additionally, since the first automatic decision mode is assigned, as the denomination of money, to the stacking unit 65*g*, "1000 yen" is assigned, as the denomination of money of the banknotes to be stacked, to the stacking unit 65*g*.

Further, among the stacking units 65*a* to 65*e* and 65*g*, at the point of time shown in FIG. 16, to which the currency and denomination of money are already assigned respectively, there is no stacking unit that is capable of stacking therein the 5000-yen banknotes. However, once the 5000-yen banknotes are recognized by the recognition unit 5, it can be seen that the stacking unit 65*h*, for which the yen (Y) is already decided as the currency and to which the denomination of money is not yet assigned, will be capable of stacking therein such 5000-yen banknotes. Thus, as shown in FIG. 17, "5000 yen" is assigned, as the denomination of money of the banknotes to be stacked, to the stacking unit 65*h*.

Similarly, once the 200-euro banknotes are recognized by the recognition unit 5, "200 euro" is assigned, as the denomination of money of the banknotes to be stacked, to the stacking unit 65*f*, as shown in FIG. 18.

Subsequently, once the 10000-yen banknotes are recognized by the recognition unit 5, such 10000-yen banknotes will be transported to the reject unit 9. This is because there is no longer any stacking unit capable of stacking therein the 10000-yen banknotes, among the stacking units 65*a* to 65*h*.

Now, still another example of the setting for the assignment mode for the respective stacking units 65*a* to 65*h* and the procedure for deciding or determining the kind or sort of the banknotes to be stacked will be described. In this example, when the handling for the banknotes is started, the assignment mode is set, as shown in FIG. 19, for the respective stacking units 65*a* to 65*h*. Again, for convenience, it is noted that the mixture mode is set concerning each of the version, orientation and fitness, and the explanation and illustration for such settings are omitted, respectively. Further, in this example, once the handling for the banknotes is started, the 50-dollar banknotes, 20-dollar banknotes, 20-euro banknotes, 1000-yen banknotes, 5000-yen banknotes, 200-euro banknotes and 10000-yen banknotes are taken in the banknote handling machine 60, respectively, in this order.

Among the stacking units at the point of time shown in FIG. 19, there is no stacking unit, to which the dollar banknote is already assigned. Therefore, once the 50-dollar banknotes are recognized by the recognition unit 5, a certain stacking unit to which the dollar banknote can be assigned is selected, among the stacking units for which the automatic decision mode that is high, in the degree of preference, second to the designation mode is set. As a result, it can be seen that the stacking units 65*a* to 65*c* of this example are set, respectively, in the first automatic decision mode concerning the currency, and that no specific or particular currency is assigned to such stacking units 65*a* to 65*c*. Thus, as shown in FIG. 20, the dollar can be assigned, as the currency of the banknotes to be stacked, to each of the stacking units 65*a* to 65*c*. Further, at the point of time shown in FIG. 19, the first automatic decision mode is set, concerning the denomination of money, for the stacking unit 65*a*, and no specific or particular denomination of money is assigned to this stacking unit 65*a*. Therefore, a certain dollar banknote can be set, newly, as the denomination of money of the banknotes, for the stacking unit 65*a*. Therefore, as shown in FIG. 20, "50 dollar" is assigned, as the denomination of money of the banknotes to be stacked, to the stacking unit 65*a*.

Further, among the stacking units of this example at the point of time shown in FIG. 20, there is no stacking unit to which the 20-dollar banknote is already assigned. Therefore, once the 20-dollar banknotes are recognized by the recognition unit 5, a certain stacking unit to which the 20-dollar banknote can be newly assigned is searched, among the stacking units to which the dollar banknote is assigned as the currency. As a result, it can be seen that the dollar banknote is already assigned, as the currency, to the stacking unit 65*b*, and that the stacking unit 65*b* is set in the second automatic decision mode concerning the denomination of money, and that no specific or particular denomination of money is assigned to this stacking unit 65*b*. Thus, as shown in FIG. 21, "20 dollar" can be assigned, as the denomination of money of the banknotes to be stacked, to the stacking unit 65*b*.

In addition, among the stacking units of this example at the point of time shown in FIG. 21, there is no stacking unit to which the euro banknote is already assigned. Therefore, once the 20-euro banknotes are recognized by the recognition unit 5, a certain stacking unit to which the euro banknote can be assigned is searched, among the stacking units for which the automatic decision mode that is high, in the degree of preference, second to the first automatic decision mode is set. Then, it can be seen that the stacking units 65*d* and 65*e* are set, respectively, in the second automatic decision mode, concerning the currency, and that no specific or particular currency is assigned to each of the stacking units 65*d* and 65*e*. Therefore, the euro banknote can be assigned to such stacking units 65*d* and 65*e*. Thus, as shown in FIG. 22, the euro is assigned, as the currency of the banknotes to be stacked, to the stacking units 65*d* and 65*e*. Further, at the point of time shown in FIG. 19, the first automatic decision mode is set, concerning the denomination of money, for the stacking unit 65*d*, and no specific or particular denomination of money is assigned to this stacking unit 65*d*. Therefore, a certain euro banknote can be set, newly, as the denomination of money of the banknotes, for the stacking unit 65*d*. Thus, as shown in FIG. 22, "20 euro" is assigned, as the denomination of money of the banknotes to be stacked, to the stacking unit 65*d*.

Further, among the stacking units at the point of time shown in FIG. 22, there is no stacking unit, to which the yen banknote is already assigned. Therefore, once the 1000-yen banknotes are recognized by the recognition unit 5, a certain stacking unit to which the yen banknote can be assigned is searched, among the stacking units for which the automatic decision mode that is high, in the degree of preference, next to the second automatic decision mode is set. Then, it can be seen that the stacking units 65*f* and 65*g* are set, respectively, in the third automatic decision mode concerning the currency, and that no specific or particular currency is assigned to each of the stacking units 65*f* and 65*g*. Therefore, the yen banknote can be assigned to such stacking units 65*f* and 65*g*. Thus, as shown in FIG. 23, the yen is assigned, as the currency of the banknotes to be stacked, to the stacking units 65*f* and 65*g*. Further, at the point of time shown in FIG. 19, the first automatic decision mode is set, concerning the denomination of money, for the stacking unit 65*f*, and no specific or particular denomination of money is assigned to this stacking unit 65*f*. Therefore, a certain yen banknote can be set, newly, as the denomination of money of the banknotes, for the stacking unit 65*f*. Thus, as shown in FIG. 23, "1000 yen" is assigned, as the denomination of money of the banknotes to be stacked, to the stacking unit 65*f*.

Further, once 1-dollar banknotes are recognized by the recognition unit 5, a certain stacking unit that will be capable of stacking therein the 1-dollar banknotes is searched, among the stacking units to which the dollar banknote is already assigned. As a result, it can be seen that the dollar banknote is already assigned, as the currency, to the stacking unit 65*c*, and that the stacking unit 65*c* is set in the third automatic decision mode concerning the denomination of money, and that no specific or particular denomination of money is assigned to this stacking unit 65*c*. Therefore, a certain denomination of money can be assigned, newly, to the stacking unit 65*c*. Thus, as shown in FIG. 24, "1 dollar" is assigned, as the denomination of money of the banknotes to be stacked, to the stacking unit 65*c*.

Thereafter, once the 5000-yen banknotes are recognized by the recognition unit 5, a certain stacking unit that will be capable of stacking therein the 5000-yen banknotes is searched, among the stacking units to which the yen banknote is already assigned. As a result, it can be seen that the yen banknote is already assigned, as the currency, to the stacking unit 65*g*, and that the stacking unit 65*g* is set in the second automatic decision mode concerning the denomination of money, and that no specific or particular denomination of money is assigned to this stacking unit 65*g*. Therefore, a certain denomination of money can be set, newly, to the stacking unit 65*g*. Thus, as shown in FIG. 25, "5000 yen" is assigned, as the denomination of money of the banknotes to be stacked, to the stacking unit 65*g*.

Thereafter, once the 200-euro banknotes are recognized by the recognition unit 5, a certain stacking unit that will be capable of stacking therein the 200-euro banknotes is searched, among the stacking units to which the euro banknote is already assigned. As a result, it can be seen that the euro banknote is already assigned, as the currency, to the stacking unit 65*e*, and that the stacking unit 65*e* is set in the second automatic decision mode concerning the denomination of money, and that no specific or particular denomination of money is assigned to this stacking unit 65*e*. Therefore, a certain denomination of money can be set, newly, to the stacking unit 65*e*. Thus, as shown in FIG. 26, "200 euro" is assigned, as the denomination of money of the banknotes to be stacked, to the stacking unit 65*e*.

In addition, another case in which the 10000-yen banknotes are recognized by the recognition unit 5 will be discussed. At the point of time shown in FIG. 26, some specific currency and particular denomination of money are already assigned, respectively, to any of the stacking units 65*a* to 65*g*, and there is no stacking unit to which the 10000-yen banknote is assigned. Therefore, once the 10000-yen banknotes are recognized by the recognition unit 5, another stacking unit that will be capable of stacking therein the 10000-yen banknotes is searched. This search is performed, in the order of the designation mode, automatic decision mode, dynamic decision mode, mixture mode and non-designation mode, in accordance with the degree of preference provided to the assignment mode. As a result, it can be seen that the stacking unit 65*h*, for which the mixture mode is set concerning the currency and denomination of money, is capable of stacking therein the 10000-yen banknotes. As such, the 10000-yen banknotes are stacked in the stacking unit 65*h*.

Thereafter, when the 5000-yen banknotes are taken out from the stacking unit 65*g*, the assignment of the yen banknote is not cleared, because the automatic decision mode is set, concerning the currency, for the stacking unit 65*g*. However, since the dynamic decision mode is set, concerning the denomination of money, for the stacking unit 65*g*, the assignment concerning the denomination of money of the banknotes and set for this stacking unit 65*g* is cleared, as shown in FIG. 27. Thereafter, if the 10000-yen banknotes are recognized by the recognition unit 5, "10000 yen" will be assigned, as the denomination of money of the banknotes to be stacked, to the stacking unit 65*g*, as shown in FIG. 28.

As stated above, according to this embodiment, the designation mode can be designated, independently or separately, for each of the stacking units 65*a* to 65*h*, as well as independently or separately, for each of the currency, denomination of money, version, orientation and fitness of the banknotes to be stacked. Further, the automatic decision mode and/or dynamic decision mode provided for deciding or determining the banknotes to be stacked depending on the recognition result obtained from the recognition unit 5 can be set, independently, for each of the stacking units 65*a* to 65*h*, as well as independently, for each of the currency, denomination of money, version, orientation and fitness of the banknotes. Furthermore, the mixture mode and/or non-designation mode can be set, independently, for each of the stacking units 65*a* to 65*h*, as well as independently, for each of the currency, denomination of money, version, orientation and fitness of the banknotes. Thus, various kinds of banknotes can be stacked, in a properly mixed state, in the stacking units 65*a* to 65*h*. However, for certain recognition factors or kinds, such as the currency and denomination of money, respectively having a certain relationship with each other and falling in a particular category, proper restriction may be provided to the setting for one factor or kind, depending on the setting for the other factor or kind.

Therefore, according to this embodiment, the degree of freedom or flexibility in the setting for each stacking unit can be significantly enhanced. As such, the banknotes can be sorted and stacked, in various sorting patterns.

In the above embodiment and in the case in which the user performs the setting for the assignment mode, as shown in FIGS. 7, 14 and 19, by using the instruction accepting unit 10, this setting may be stored in the memory 80. With this operation, the setting for a certain assignment mode can be read with ease from the memory 80. Thus, the handling for the banknotes can be started, in a significantly quick manner, without the need for performing again such a complicated setting for the assignment mode.

Further, in the above embodiment, proper color-light emission units may be arranged in the vicinity and/or on the periphery of a banknote take-out slot of each stacking unit. With such arrangement, the light emission units can emit light of the same color, for the stacking units respectively stacking therein the banknotes of the recognition factors or kinds respectively falling in the same or similar category. For instance, in the case in which the dollar banknotes are stacked in the stacking units 65*a* to 65*d*, respectively, and in which the euro banknotes are stacked in the stacking units 65*e* and 65*f*, respectively, and in which the yen banknotes are stacked in the stacking units 65*g* and 65*h*, respectively, the aforementioned arrangement can enable some emission units, respectively corresponding to the stacking units 65*a* to 65*d*, to emit red light, and enable other emission units, respectively corresponding to the stacking units 65*e* and 65*f*, to emit green light, as well as enable the other emission units, respectively corresponding to the stacking units 65*g* and 65*h*, to emit blue light. In this way, the user can readily check certain stacking units, respectively stacking therein the banknotes of the recognition factors or kinds respectively falling in the same or similar category, and thus the efficiency in handling the banknotes can be significantly enhanced.

Further, the banknote handling machine 60 may be adapted for informing the user of inadvertent or improper selection of some restricted assignment mode and/or some unsuitable assignment mode. For instance, upon setting the assignment mode concerning the currency, if the user selects the second automatic decision mode without the first automatic decision mode being set for any of the related stacking units, the banknote handling machine 60 is capable of driving a suitable display unit to display the fact that such selection cannot be performed, or otherwise capable of generating a beep sound.

Additionally, in the above embodiment and in the case in which the same kind or sort of the banknotes is assigned to two or more stacking units, such stacking units or destination, to which the banknotes of the same kind or sort will be transported, may be decided or determined at random, or otherwise such banknotes may be transported, preferentially, to certain stacking units respectively located near the take-in unit 2 and/or instruction accepting unit 10.

Further, in the above embodiment, although eight stacking units are provided in the banknote handling machine 60, the number of the stacking units may be less than eight, or otherwise may be greater than eight.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

The invention claimed is:

1. A banknote handling machine comprising:

a take-in unit configured to take in a plurality of banknotes, one by one;

a recognition unit configured to recognize a kind of each banknote taken in by the take-in unit;

a plurality of stacking units configured to stack therein the banknotes;

a transport unit configured to transport the banknotes, recognized by the recognition unit to any of the plurality of stacking units;

an instruction accepting unit configured to accept an instruction concerning an automatic decision mode provided for deciding the kind of the banknotes to be stacked for one transaction by utilizing a recognition result obtained by the recognition unit, for each of the plurality of stacking units; and a control unit configured to control the transport unit to transport each banknote to a destination, which destination is decided based on the instruction accepted by the instruction accepting unit and on the recognition result obtained by the recognition unit, wherein the automatic decision mode for the banknotes to be stacked includes a first automatic decision mode and a second automatic decision mode, the first automatic decision mode being provided for deciding a first kind of the banknotes that has been recognized first by the recognition unit, as the first kind of the banknotes to be stacked in any of the stacking units, and the second automatic decision mode being provided for deciding a second kind of the banknotes that is different than the first kind of banknotes and has been secondarily recognized by the recognition unit, as the second kind of the banknotes to be stacked in any of the stacking units, wherein the first kind of the banknotes are transferred to a stacking unit which is set in the first automatic decision mode, and the second kind of the banknotes are transferred to a stacking unit which is set in the second automatic decision mode.

2. The banknote handling machine according to claim 1, wherein the instruction accepting unit is configured to accept an instruction concerning the kind of the banknotes to be stacked, for each of the plurality of stacking units.

3. The banknote handling machine according to claim 1, wherein the instruction accepting unit accepts the instruction concerning the kind of the banknotes to be stacked, for each of the plurality of stacking units, and when the kind of the banknotes to be stacked in a first stacking unit has been assigned and the first automatic decision mode has been set for a second stacking unit, the control unit controls the transport unit to transport, to the second stacking unit, banknotes whose kind is recognized first by the recognition unit and is different from the kind that has been assigned to the first stacking unit.

4. The banknote handling machine according to claim 1, wherein the automatic decision mode for the banknotes to be stacked includes a dynamic decision mode provided for deciding the kind of the banknotes that has been recognized first by the recognition unit and is different from each kind of the banknotes assigned to certain stacking units, as the kind of the banknotes to be stacked in another stacking unit than the certain stacking units, and when all of the banknotes are taken out from a first stacking unit for which the dynamic decision mode is set, the control unit newly decides the kind of the banknotes that is recognized first by the recognition unit after the banknotes are taken out and has not been assigned to any of the other stacking units, as the kind of the banknotes to be stacked in the stacking unit, from which all of the banknotes have been taken out.

5. The banknote handling machine according to claim 1, wherein the kind of the banknotes includes the kind related to at least one category of denomination, orientation, fitness and version.

6. The banknote handling machine according to claim 1, wherein the kind of the banknotes includes the kind related to a plurality of categories selected from denomination, orientation, fitness and version, and the instruction accepting unit accepts the instruction concerning the automatic decision mode, independently, for denomination, orientation, fitness and version.

7. The banknote handling machine according to claim 1, further comprising a reject unit configured to stack therein reject banknotes and banknotes not stacked in the plurality of stacking units.

8. The banknote handling machine according to claim 1, further comprising a display unit configured to display each kind of the banknotes to be stacked in each stacking unit.

9. The banknote handling machine according to claim 1, further comprising a plurality of display units, wherein each of the display units displays the kind of the banknotes to be stacked in the respective corresponding stacking unit.

* * * * *